United States Patent [19]

High

[11] 4,037,781

[45] July 26, 1977

[54] DECANTER CENTRIFUGE APPARATUS

[75] Inventor: Robert Edward High, St. Ives, Australia

[73] Assignee: Pennwalt Corporation, Philadelphia, Pa.

[21] Appl. No.: 672,698

[22] Filed: Apr. 1, 1976

[30] Foreign Application Priority Data

| | | |
|---|---|---|
| Apr. 1, 1975 | Australia | 1058/75 |
| Nov. 24, 1975 | Australia | 4062/75 |

[51] Int. Cl.[2] ..... B04B 1/20

[52] U.S. Cl. ..... 233/7

[58] Field of Search ..... 233/3, 7

[56] References Cited

U.S. PATENT DOCUMENTS

| | | | |
|---|---|---|---|
| 1,710,316 | 4/1929 | Laughlin | 233/7 |
| 2,054,058 | 9/1936 | Laughlin | 233/7 |
| 2,919,848 | 1/1960 | Howe | 233/7 |
| 3,501,346 | 3/1970 | Katzen et al. | 233/7 X |
| 3,885,734 | 5/1975 | Lee | 233/7 X |

FOREIGN PATENT DOCUMENTS

| | | | |
|---|---|---|---|
| 647,761 | 3/1964 | Belgium | 233/7 |
| 723,408 | 8/1943 | Germany | 233/7 |
| 661,668 | 6/1938 | Germany | 233/7 |
| 1,369,521 | 10/1974 | United Kingdom | 233/7 |

*Primary Examiner*—George H. Krizmanich
*Attorney, Agent, or Firm*—Edward A. Sager

[57] ABSTRACT

This invention relates to centrifugal separators but more particularly to a solid bowl centrifugal separator for separating a coarse solids fraction, a fine solids fraction and one or two liquid fractions having different specific gravities from feed comprising a liquid-solids mixture. The present invention relates to a solid bowl centrifugal separator which comprises an elongated bowl tapered at both ends and mounted for rotation about an axis. Coaxially mounted within the bowl is a helical screw conveyor having portions of opposite pitch to transport each of the two solids fractions towards their respective discharge ports located in the tapered ends of the bowl. Means are also provided for the discharge from the bowl of two liquid fractions of differing specific gravity. Each of the fractions is discharged into separate segments in the collector casing. More efficient separation is accomplished and efficient separation may be achieved in a single centrifuging step where heretofore two or more consecutive centrifuging operations were required.

5 Claims, 5 Drawing Figures

DECANTER CENTRIFUGE APPARATUS

This invention relates to decanter centrifuges, and more particularly to continuous solid bowl centrifuges.

Decanter centrifuges are widely used for the separation of sedimentable solids from slurries. Such centrifuges usually consist of an imperforate rotating cylindrical bowl assembly tapered at one end in which is mounted a helical screw conveyor of single pitch rotating about the same axis but at slightly different angular velocity. Feed slurry is introduced into the bowl through a stationary feed pipe. Under the influence of centrifugal force within the rapidly rotating bowl assembly the solids sediment to the bowl wall and are continuously removed from the tapered end of the bowl via a suitably located discharge port by the action of the screw conveyor, the clarified liquid continuously flowing over an adjustable weir at the opposite end of the bowl. The radial distance of the liquid discharge weir from the axis of rotation is greater than the radial distance of the solids discharge port from the axis of rotation to form a dry beach section to allow drainage of liquid from the solid before discharge of the solids through the discharge port. Equipment of the above kind has proved effective for two phase separation of slurries into a solid fraction and a clarified liquid fraction.

With the conventional decanter centrifuge as described above, difficulty may be experienced in transporting soft solids out of the annular liquid pool towards the discharge port against the centrifugal force generated within the bowl. If the pool depth within the bowl during operation is increased to a point where the inner radius of the annular liquid pool is close to, or even less than, the radial distance of the solids discharge port from the axis of rotation in order to discharge the soft solids, it is possible to obtain a lower solids content in the clarified effluent but the liquid content of the discharged solids is increased because it is no longer possible to drain surface moisture from the coarse solids on a dry beach section. See U.S. Pat. No. 3,172,851.

In recent years three phase decanter centrifuges have been developed to separate simultaneously two liquid phases of differing density from a feed slurry containing a mixture of liquids and solids. See U.S. Pat. No. 3,934,792. Such three phase decanters generally discharge the solids from one end of the bowl and attempt to separate the two liquid phases in the opposite end of the bowl beyond the end of the screw conveyor. Such three phase decanters suffer from two major operating problems, firstly deposition of the fine solids in the separating zone beyond the conveyor and secondly accumulation of floating solids (that is solids having a specific gravity between the specific gravities of the two liquid phases) and/or emulsion at the interface of the two liquid layers.

It is the principal object of the invention to provide a solid bowl decanter centrifuge which is substantially free from the above problems.

According to one general form the invention provides a solid bowl decanter centrifuge comprising a rotatable elongated bowl with tapered opposite end portions to form internal inclined annular surfaces, an axial screw conveyor rotatable within the bowl and having portions of opposite pitch, means for rotating said bowl and screw conveyor at different speeds, means for depositing a sludge within the bowl for separation of its distinct phases, means for discharging two solid phases of said sludge at respective ones of said end portions of the bowl, and means for draining the liquid from the bowl between said end portions.

The invention will now be described in greater detail with reference to the accompanying drawings, in which.

Three basic embodiments will be described which are suitable for separating the appropriate feed slurry into different fractions, namely:

1. Coarse solids, fine solids and clarified liquid effluent.
2. Coarse solids, light phase liquid and a mixture of heavy phase liquid and fine solids.
3. Coarse solids, fine solids, light phase liquid and heavy phase liquid.

1. SEPARATION OF SLURRIES CONTAINING PHASES OF COARSE SOLIDS, FINE SOLIDS AND CLARIFIED EFFLUENT

To facilitate comparison with a conventional decanter centrifuge, the operation of a first embodiment of the invention will firstly be described where the feed slurry contains suspended solids which themselves can be divided into two fractions, or phases, consisting of "coarse solids" and "fine solids". "Coarse solids" are defined as those which sediment rapidly and which can be readily scrolled up a tapered end section of the bowl of the centrifuge to a discharge port which can be located at a smaller radius than the radius of the inner surface of the liquid within the bowl. "Fine solids" consist of fine particles which sediment only slowly and are therefore deposited against the bowl wall at a greater axial distance from the feed zone than are the coarse solids.

Figure 1:
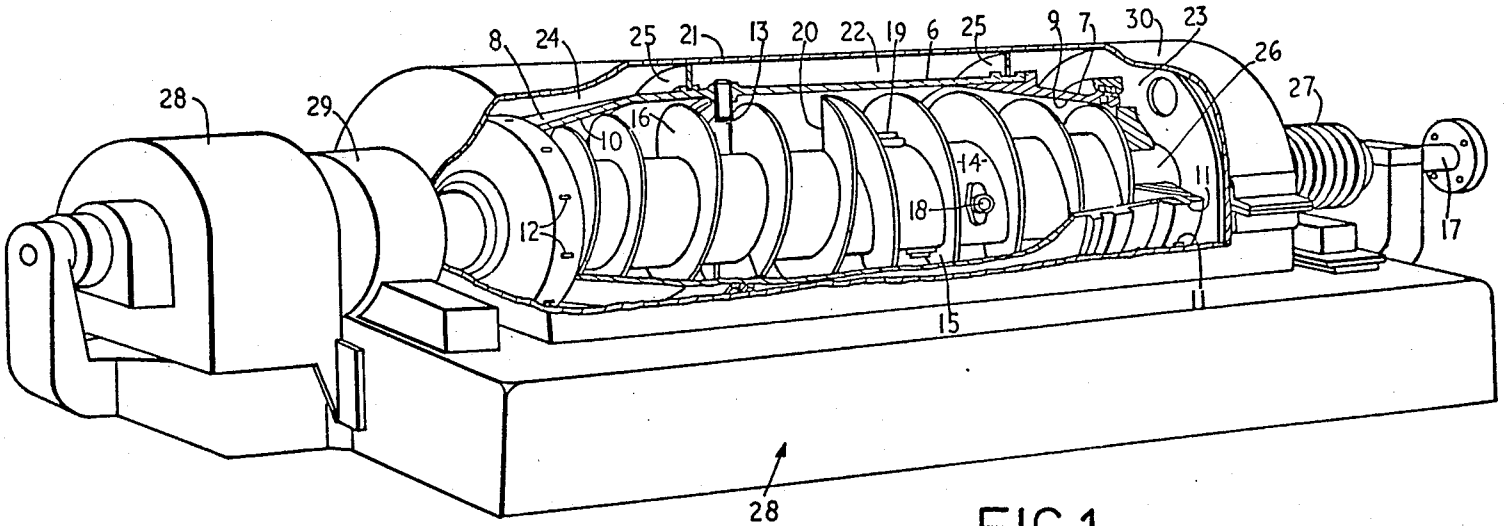
FIG. 1 is a perspective part sectional view of a solid bowl decanter centrifuge incorporating the basic features of the invention.

The basic elements of a solid bowl decanter centrifuge capable of incorporating the features of the several embodiments of this invention are shown in FIG. 1.

The centrifuge preferably consists of a rotatable elongated bowl 6 having tapered opposite end portions 7 and 8 to form beaches 9 and 10 terminating in respective discharge ports 11 and 12 through which is discharged respectively coarse solids and fine solids. For simplicity, we will refer to the tapered end 7 of the bowl 6 containing the coarse solids discharge ports 11 as the rear end and to the opposite end 8 of the bowl 6 as the front end. A radially disposed discharge pipe or tube dam 13 drains off clarified liquid from the surface of an annular liquid pool formed during operation within the bowl 6. A conveyor 14 having two oppositely-handed (or pitched) flights 15 and 16 tapering at their ends if rotatably supported in the bowl 6. A stationary feed pipe 17 deposits slurry via feed ports 18 and 19 mounted in the conveyor 14 at a position between the offset inter-connection 20 of the conveyor pitches 15 and 16 and the rear solids discharge port 11. The axial position of deposition of the slurry may be varied. The bowl 6 is enclosed within a casing 21 and the space between the bowl and casing is divided into a central chamber 22 and two end chambers 23 and 24 by partitions 25. Solids phases of the feed slurry are confined to and discharged via respective end chambers 23 and 24 while the liquid phase is confined to and discharged via the central chamber 22. The bowl 6 is connected at the rear end by a shaft 26 to a drive pulley 27 and the conveyor 14 is connected at the front end to a power unit 28. The casing 21 is fixedly supported upon a base 28 providing suitable bearings 29 and 30 for the driving shafts.

Figure 2:
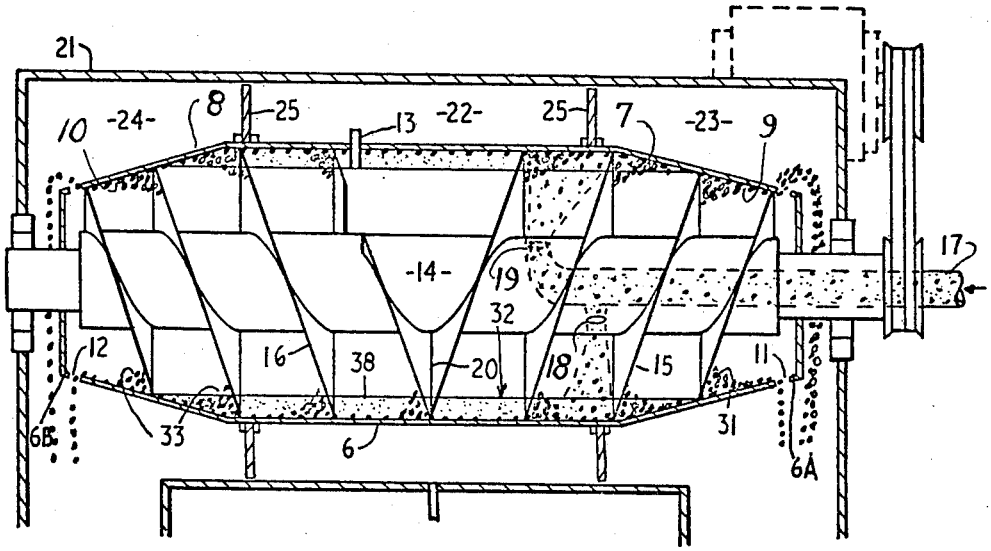
FIG. 2 is a dynamic schematic illustration of a centrifuge according to a first embodiment.

FIG. 2 shows schematically the centrifuge of FIG. 1 in dynamic state and supplied with feed slurry. The operation of this first embodiment will be described with reference to these two figures. Coarse solids 31 are deposited in the region between the rear solids discharge port 11 and the inter-connection point 20 of the conveyor pitches and are continuously advanced towards the rear end 6A of the bowl 6 by the rearward facing flight 15 of the screw conveyor 14. Partly clarified liquid 32 and the suspended fine solids 33 which are not sedimented against the bowl wall in the region between the rear solids discharge port 11 and the point 20 are not transported by the rear facing portion of the screw conveyor 14 and flow towards the front end 6B of the bowl 6. Fine solids 33 sedimented in the region of the bowl between the point 20 and the front solids discharge port 12 are transported towards the front solids discharge port 12 by the forward facing flight 16 of the screw conveyor 14. The front discharge ports 12 which are located in the front tapered end 6B of the bowl 6 may be located at a greater or smaller radius from the axis of rotation than are the rear solids discharge ports 11. Clarified liquid 32 is removed from the surface of the annular pool by the discharge tube dam 13 which may be adjustable, or by means of a well known skimmer pipe arrangement (not shown).

The conveyor flights 15 and 16, particularly in the axial section between the feed entry ports 18 and 19 and the clarified liquid effluent pipe 13 may be perforated to allow axial flow of liquid to reduce turbulence and thus improve operating efficiency. At the intersection point 20 of the oppositely handed conveyor flights 15 and 16, forward facing flights 16 having a smaller radial length may be continued towards the rear end 6A of the bowl, the outer radius of these shorter flights may then be used to support the rearward facing conveyor flights 15 which extend to near the bowl wall. In this area where the oppositely pitched flights are super-imposed upon each other the rear facing conveyor flights 15 will transport coarse solid which has been deposited against the bowl wall towards the rear discharge port 11 while the fine solids which have been deposited as a soft sludge layer on the inner surface of the coarse solids layer will be transported towards the front discharge port 12 by the forward facing conveyor flights 16.

Where the liquid phase 32 is discharged via the tube dam 13 located in the bowl wall, the conveyor flight is gapped or interrupted to avoid mechanical interference between the conveyor flight which is rotating relative to the bowl wall. Fine solids are transported across this gap in the flight either by the pushing action of the layer of fine solids 33 being transported towards the front discharge ports 12 by the front facing conveyor flights 16 on the feed zone side of the gap or by the difference in hydraulic pressure between the central chamber 36 and the front solids discharge chamber 37 or a combination of both influences.

Figure 3:
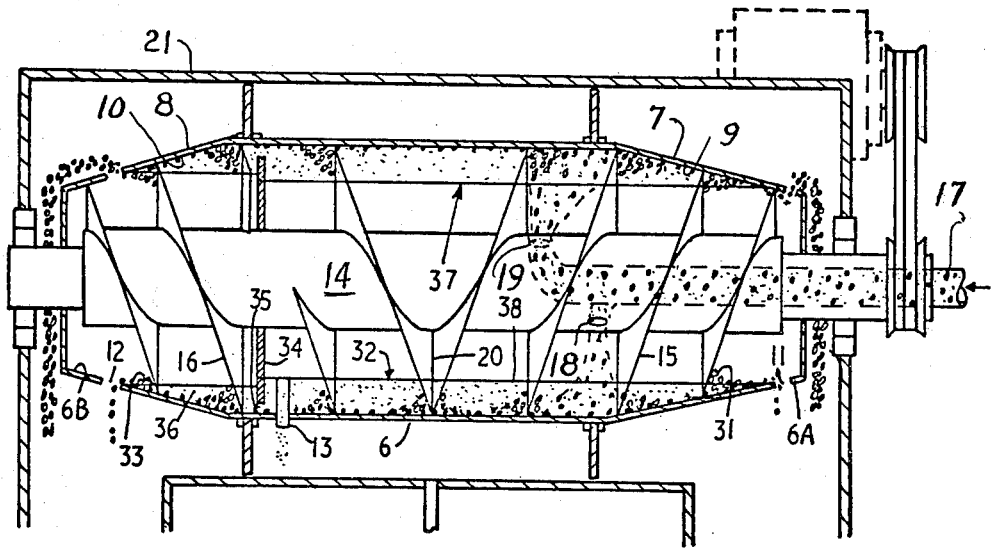
FIG. 3 is a lower half representation of the schematic of FIG. 2 showing the addition of a baffle.

In many cases the fine solids fraction 33 will not compact to a readily transportable cake and is therefore difficult to transport along the tapered section 8 of the bowl 6 towards the front discharge ports 12. The disclosure of U.S. Pat. No. 3,795,361 and U.S. patent application Ser. No. 538,492, now U.S. Pat. No. 3,934,792 teach a method and apparatus for assisting the transport of soft solids to the appropriate discharge port by the addition of a suitable baffle located between the liquid discharge port and the soft solids discharge port in order to modify the relative radial distances from the rotation axis of the liquid level and and soft solids discharge port such that the inner surface of the clarified liquid annular layer may be at a smaller radius from the axis of rotation than is the soft solids discharge port. FIG. 3 shows the addition of such a baffle 34 whereby the soft solids 33 will then flow through the passage 35 defined by the periphery of the baffle 34 and the bowl wall towards the discharge port 12 under the combined influence of the screw conveyor 14 and the hydraulic head generated by the layer of liquid 32 within the bowl 6. This baffle 34, which is like baffle 66' in FIG. 2 of U.S. Pat. No. 3,795,361, will be referred to hereafter as the front conveyor baffle. According to the above-mentioned U.S. Pat. No. 3,795,361 and application Ser. No. 538,492 this baffle may take many forms. Its effect is to divide the bowl 6 into two separate chambers, the chambers located between the front baffle 34 and the front discharge port 6B will be referred to as the front discharge chamber 36 while the chamber located on the feed zone side of the front baffle 34 will be referred to as the central chamber 37.

It is generally desirable to have a radial distance of the coarse solids discharge port 11 located in the rear tapered end 6A of the bowl at a smaller radial distance from the bowl axis than is the radius of the inner surface 38 of the liquid pool within the bowl 6. This allows surface liquid to be drained from the coarse solids 31 on the tapered portion 7 immediately piror to discharge thus reducing the liquid content of the coarse solids fraction 31. According to the present invention, the radial distance from the bowl axis of the fine solids discharge port 12 located in the front tapered end 6B of the bowl 6 can be independently adjusted relative to the inner radius 38 of the liquid pool within the bowl 6 to obtain the optimum condition of liquid effluent clarity versus liquid content of the fine solid phase 33 discharge.

The embodiment of the present invention described above is capable of continuously separating a feed slurry containing sedimentable coarse or rapidly settling solids, sedimentable fine or slowly setting solids and liquid into three phases. Some of the advantages of the present invention over the conventional two phase solid bowl centrifuge are:

The coarse and fine solids phases, or fractions, 31 and 33, respectively, are simultaneously separated from each other and from the liquid phase 32. In many processes, for example classification and dewatering of wheat starches and mineral clays, two stages of conventional centrifuges would be required. In other processes, for example dewatering of sewage sludges, it has not previously been practicable to separate the solids into two separate phases. With the present invention it becomes possible to subject each of the two solids fractions produced to different subsequent processing steps, for example, pressing, disposal by land fill or incineration, lagooning, etc., whereas the mixture of coarse and fine solids may not be suitable for such subsequent treatment.

Optionally, washing liquid, usually water, may be introduced as shown in the FIG. 2 arrangement of U.S. Pat. No. 3,428,246 wherein a suitable separate wash supply tube designated therein as 66 and feed port arrangement (provided by removing plug 68 of the cited patent) to arrange for wash liquid to impinge upon the coarse solids fraction 31 being transported towards the rear discharge port 11 along that portion of the tapered end 7 of the bowl 6 not in contact with liquid. The wash liquor will scour fine solids from the dry beach so that they flow back into the liquid pool together with the wash liquid. This facility reduces the fine solids content of the coarse solids fraction. In the case of wheat starch, for example, this results in a higher quality coarse fraction 31.

In a conventional decanter centrifuge, it is desirable to have the solids discharge port 11 at a radial distance from the axis of rotation considerably smaller than the inner radius 38 of the liquid pool within the bowl 6 in order to produce an area on the tapered portion 7 of the bowl 6 from which liquid can be drained away from the solids as they are transported towards the solids discharge port 11. However, fine solids 33 may not compact sufficiently to enable them to be transported along the tapered portion 7 of the bowl not in contact with the liquid layer; they then accumulate within the centrifuge bowl 6 until they are eventually lost with the partly clarified liquid effluent phase 32. In the present invention the difference between the radial distance from the axis of rotation of the coarse solids discharge port 11 and the radius of the inner surface 38 of the liquid pool may be adjusted independently of the difference between the radial distance from the axis of rotation of the fine solids discharge port 12 and the radius of the said inner liquid surface 38. This allows optimum concentration of the coarse solids phase 31 and optimum clarity of the liquid effluent phase 32.

Some feed slurries, for example waste activated sludge industrial effluents, frequently contain small quantities of abrasive material, such as sand. This abrasive material generally has a greater settling velocity than the bulk of the solids being processed. These abrasive solids sediment rapidly within the decanter centrifuge and are readily transported along the bowl 6 by the rear facing conveyor flights 15 towards the rear solids discharge port 11. By introducing the feed material at a longitudinal position nearer to the rear discharge port 11, the proportion of the screw conveyor 14 subject to abrasive wear is considerably reduced. The feed ports 18 and 19 may be located adjacent the tapered end portion 7 of the bowl 6. Since the rate of abrasion is a function of the centrifugal force which in turn is a function of the distance from the axis of rotation, this will further reduce the abrasion of the screw conveyor 14. This facility allows the centrifuge to be operated at greater rotational speeds while limiting the rate of wear of the screw conveyor 14 to an acceptable level, the solid and liquid phases being transported towards the front end 6B of the bowl 6 are then subjected to greater centrifugal action and are thus more efficiently separated than if the speed of rotation was reduced to limit the effect of abrasion. In a conventional two phase decanter centrifuge, it is not usually practical to locate the feed ports 18 and 19 in this manner because the shallow depth of liquid flowing towards the liquid discharge pipe 13 would cause considerable turbulence and reduce the recovery of fine solid particles 33.

2. SEPARATION OF SLURRIES CONTAINING PHASES OF COARSE SOLIDS, LIGHT PHASE LIQUID AND A MIXTURE OF HEAVY PHASE LIQUID AND FINE SOLIDS

The operation of the centrifuge will now be described when the feed material contains two immiscible liquids of different specific gravity (light phase liquid and heavy phase liquid) in addition to solids. The light phase liquid being equivalent to the liquid phase 32 and the heavy phase liquid being equivalent to the fine solids phase 33, respectively, referred to in the foregoing description.

Figure 4:
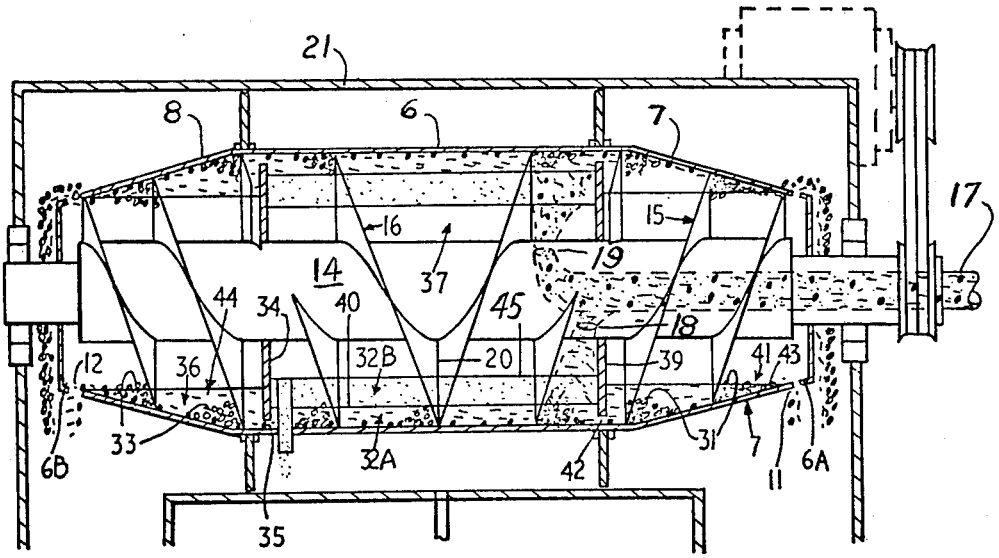
FIGS. 4 and 5 are similar representations of the schematic of FIG. 2 and shows second and third embodiments of the invention.

By adjusting the radius of the inner surface 38 of the light phase liquid to be suitably smaller than the radial distance of the front discharge ports 12 from the axis of rotation, an annular layer of light phase liquid is contained in the central chamber 37 between the front baffle or primary baffle 34 and the rear discharge port 11. The outer radius of the light phase liquid layer will correspond to the inner radius of the heavy phase liquid layer and is such that the combined hydraulic pressure of the light phase liquid layer and heavy phase liquid layer in the central chamber 37 is balanced by the heavy phase liquid layer in the front discharge chamber 36 on the opposite side of the front conveyor baffle 34. The outer radius of the light phase liquid layer is essentially independent of the proportion of either phase in the feed mixture and of the total feed rate. In many cases, for example clarification of animal tallow or vegetable oil, the coarse solids should be discharged with a minimal light phase liquid content in order to maximize the recovery of light phase liquid. In such cases, see FIG. 4, a second, rear, baffle or auxiliary baffle 39 is attached to the screw conveyor 14 and is located at a point on the bowl axis between the feed ports 18 and 19 and the rear discharge ports 11, the outer periphery of this baffle being at a greater radial distance from the axis of rotation than is the radius of the outer surface 40 of the light phase liquid layer 32B. The rear baffle 39 thus forms a separate chamber 41 at the rear end 6A of the bowl 6. The rear conveyor baffle 39 prevents light phase liquid 32B, which enters the central chamber 37 from the feed zone, entering the rear discharge chamber 41. Thus, the coarse solids 31 being transported along the rear beach 7 of the bowl 6 towards the rear discharge port 11 do not pass through a layer of light phase liquid 32B as they are transported out of the heavy phase liquid layer 32A in the rear discharge chamber 41 and this results in a lower light phase liquid content of the coarse solids phase discharged.

The operation of the decanter centrifuge of the invention fitted with front and rear baffles 34 and 39 when fed with a feed slurry containing two immiscible liquids and solids is as follows:

The mixture of light and heavy phases 32, coarse and fine solids 31 and 33, flows through the feed ports 18 and 19 into the central chamber 37 located between the rear and front conveyor baffles 39 and 34. Coarse solids 31 which are deposited against the bowl wall in the region between the rear discharge ports 11 and the point 20 where the conveyor pitches join are continually advanced towards the rear discharge ports 11 by the rear phasing conveyor flights 15. Coarse solids 31 pass through the passageway 42 between the outer periphery of the rear baffle 39 and the bowl wall into the rear discharge chamber 41. They are further transported from the rear chamber 41 by the rear conveyor flights 15 in the tapered portion 7 of the rear chamber 41 to the rear discharge ports 11 and discharged therefrom. Fine suspended solids 33 and both liquid phases 32A and 32B are not transported by the rear portion 15 of the screw conveyor 14 and migrate towards the front end 6B of the bowl 6 under the combined influence of the liquid flow and the front facing screw conveyor flights 16. Light phase liquid 32B is contained in the central chamber 37 between the rear and front conveyor baffles 39 and 34 and is discharged through a light phase liquid tube dam 13. Heavy phase liquid 32A entering in at the feed ports 18 and 19 forms a layer between the light phase liquid layer 32B and the solids deposited on the bowl wall. Heavy phase liquid 32A may flow via passages 35 and 42 under the front and rear baffles 34 and 39 into the front and rear discharge chambers 36 and 41 respectively. The inner radial surface 43 of the heavy phase liquid layer 32A within the rear discharge chamber 41 will be at a greater radial distance from the axis of rotation than are the rear discharge ports 11 and the inner radial surface 44 of the heavy phase liquid layer 32A within the front discharge zone 36 is at a greater distance from the axis of rotation than is the inner radial surface 45 of the light phase liquid layer within the central chamber 37. Heavy phase liquid 32A flows from the feed zone into the front discharge chamber 36 and is discharged from the adjustable front discharge ports 12 which are located at a greater radius from the axis of rotation than is the surface 45 of the light liquid phase 32B within the central chamber 37.

Fine solids 33 are transported towards the front discharge ports 12 under the combined influence of the front conveyor flights 16 and the flow of the heavy phase liquid 32A towards the front discharge chamber 36 and are discharged through the front discharge ports 12 together with the heavy phase liquid 32A.

3. SEPARATION OF SLURRIES CONTAINING PHASES OF COARSE SOLIDS, FINE SOLIDS, LIGHT PHASE LIQUID AND HEAVY PHASE LIQUID

In many instances, for example in the processing of crude animal fat or crude vegetable oil mixtures, it is found that the feed slurry contains a total of four phases of differing density, For example, if a sample of crude wet rendered animal fat is spun in a test tube centrifuge, it will separate into four distinct phases, in order of increasing density, they are:

Oil
Floating solids/emulsion
Water solution
Sedimentable solids

The floating solids/emulsion phase will contain incompletely rendered particles in which both solids and fat are present, these particles have a bulk density lighter than the solids (and water) but heavier than clarified fat. In a conventional centrifugal separation process, a decanter centrifuge is used to remove the bulk of the sedimentable solids, the partly clarified effluent is then subsequently separated into water, oil and solids/emulsion phases in a second separator type centrifuge. The floating solids/emulsion phase causes blockages and high fat losses in the separator centrifuge. In the three phase centrifuge described earlier, these floating solids can be discharged together with the water phase but this results in a water phase containing significant quantities of both fat and solids. Also, accumulation of the floating solids within the centrifuge bowl 6 shown in FIG. 4 at the interface between the light phase liquid layer 32B and heavy phase liquid layer 32A, can lead to mechanical blockages. The emulsion or floating solid particles are trapped at the oil water interface and can only escape from the central chamber 37 after they have accumulated to a sufficient depth so as to displace either the heavy liquid phase 32A or light liquid phase 32B from the central chamber 37.

Figure 5:
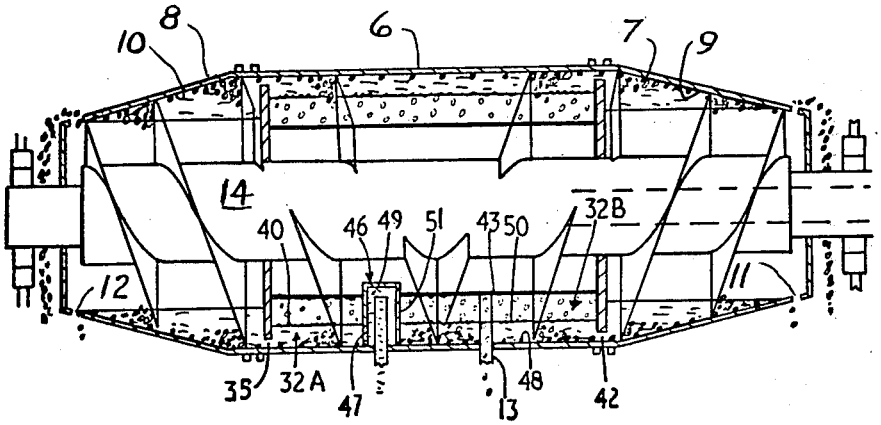

In order to discharge the four separate phases present within the centrifuge bowl 6, it is necessary to add an additional discharge port. With reference to FIG. 5, this is achieved by adding at least one heavy phase liquid discharge tube dam 46 having an inlet port 47 located within the central chamber 37 at a radial distance from the axis of rotation greater than the outer radius 40 of the light phase liquid layer 32B and smaller than the inner radius 48 of the fine solids layer 33 deposited against the bowl wall, so that only heavy phase liquid 32A may enter the inlet port 47. Heavy phase liquid 32A entering the inlet port 47 flows over an adjustable weir 49 within the heavy phase discharge tube dam 46 before discharging into the collector casing. The radial distance of this weir 49 from the axis of rotation of the centrifuge is adjusted to achieve hydraulic balance between the heavy phase liquid layer 32A within the discharge tube dam 46 and the combined pressure of the light phase layer 32B, floating solids/emulsion layer 50 and heavy phase liquid layer 32A within the central chamber 37 and adjacent to the outside surface 51 of the heavy phase liquid discharge tube dam 46. The heavy phase liquid discharge tube dam 46 discharges into a separate compartment (not shown) in the collector casing 21 (see FIG. 1).

It can be seen that the outer surface 51 of the heavy phase discharge tube dam 46 serves the same function as the front baffle 34 which previously separated the central chamber 37 from the front discharge chamber 36 from which the heavy phase liquid 32 was discharged in the three phase version of the first embodiment above. Therefore, the baffle 34 may be omitted. Also, the adjustable weir 49 within the heavy phase liquid discharge tube dam 46 serves the function of adjustable front discharge ports 12 from which the heavy phase liquid was discharged. By adjusting the front discharge ports 12 to a radial distance from the axis of rotation smaller than the radial distance from the axis of rotation of the weir 49 within the water discharge tube dam 46, heavy phase liquid 32A will discharge only through the heavy phase discharge tube dam 46. The floating solid/emulsion phase 50 is transported from the interface 40 between the light phase liquid 32B and heavy phase liquid 32A adjacent to the front tapered end 8 of the bowl 6 by the forward facing flights 16 of the screw conveyor 14 towards the front discharge ports 12 where they are discharged together with the fine solids 33. By including the front baffle 34 as shown in FIG. 5, it will serve to separate the floating solids from the light liquid phase 32B before discharge via ports 12. It will be noted that the periphery of the baffle 34 is at a less radial distance from the rotational axis than is the periphery of the rear baffle 39.

The heavy phase liquid discharge tube dam 46 may be located in the same axial cross section of the centrifuge bowl 6 as is the light phase discharge tube 13, the light phase liquid 32B and heavy phase liquid 32A then being diverted into separated sections of the collector casing by a suitable piping arrangement attached to or within the walls of the centrifuge bowl 6, or the light phase liquid 32B may be removed by a skimmer pipe.

This four phase embodiment of the decanter centrifuge reduces the possibility of floating solids causing blockages within the centrifuge bowl 6 and discharges the floating solids 50 together with the fine solids 33 in a concentrated form which allows of their being subjected to further processing. The heavy phase liquid 32A discharging through the heavy phase liquid tube 46 contains a much lower proportion of fine solids and floating solids.

What is claimed is:

1. A solid bowl decanter centrifuge comprising a rotatable cylindrical bowl with conically tapering first and second opposite end portions each forming an internal inclined annular surface, a screw conveyor rotatable within and on the axis of the bowl and having first and second end parts of opposite pitch within the respective first and second end portions of the bowl, means for rotating said bowl and screw conveyor at different speeds, means for depositing a sludge within the bowl for separation of its different phases, means for discharging heavy and light solids phases of said sludge at the respective first and second end portions of the bowl, means for draining a liquid phase from the bowl between said end portions, said first and second opposite end portions of said bowl having respective first and second weirs to retain in the bowl during operation an annular pool of sludge, a heavy solids phase of the sludge being lifted from said pool and discharged over the first weir at said first end portion by the first end part of said screw conveyor, said means for draining the liquid phase of said sludge being a tube fixed to and passing through said bowl and having an inner orifice as an entry for said liquid phase, said orifice being spaced radially from the rotational axis of said bowl a greater distance than said first weir, a light solids phase of the sludge being discharged over the second weir at said second end portion, the second weir having a radial spacing from the rotational axis of said bowl which is intermediate that of said first weir and that of said liquid phase orifice, a primary radial baffle having its outer periphery spaced from the inner wall of said bowl to provide a passage, said primary baffle being secured to the screw conveyor at a position between said second weir and said liquid phase tube, said second weir having a radial spacing from the rotational axis of said bowl which is greater than that of said liquid phase orifice, whereby the light solids phase is discharged over the second weir by combined action of said screw flights and the hydraulic pressure of said liquid phase communicated via said passage, and an auxiliary radial baffle secured to said screw conveyor which is located between said liquid phase tube and the first weir, whereby in operation a light liquid phase of the sludge is confined between the primary and auxiliary baffles and is discharged via the liquid phase tube while a heavy liquid phase is discharged via said passage and over the second weir.

2. A decanter centrifuge according to claim 1, wherein the bowl is enclosed within a casing having separate discharge chambers to receive from said bowl respective distinct phases of said sludge as they discharge from said bowl.

3. A decanter centrifuge according to claim 1, wherein said end points of opposite pitch of the screw conveyor interconnect at an intermediate point within the bowl, and said means for depositing the sludge includes means conveying the sludge to the interior of the screw conveyor and port means in the screw conveyor through which the sludge passes into said bowl, said port means being longitudinally positioned on the screw conveyor between said intermediate point and one end of said bowl.

4. A decanter centrifuge according to claim 1, wherein said screw conveyor has screw flights which are cylindrically coiled over an intermediate part of the length of said screw conveyor and are conically coiled at said opposite end portions of said screw conveyor, and the dimensions of said screw conveyor are such that the distal edges of said flights complement the inside contour of said bowl.

5. A decanter centrifuge according to claim 1, provided with an additional liquid phase tube which has its inner end closed and its orifice provided in a side wall at a position whose radial spacing from the rotational axis of the bowl is greater than that of said orifice of said first-mentioned liquid phase tube, and said additional tube has an internal weir spaced towards the inner end of said additional tube, whereby in operation a heavy liquid phase passes through said side wall orifice and over said internal weir before being discharged from said bowl.

* * * * *